United States Patent [19]

Fikentscher et al.

[11] Patent Number: 4,592,757

[45] Date of Patent: Jun. 3, 1986

[54] PRODUCTION OF DYED OR UNDYED WOOL WITH AN ANTIFELTING FINISH: QUATERNIZED PIPERAZINE CONDENSATE

[75] Inventors: Rolf Fikentscher, Ludwigshafen; Heinrich Mertens, Frankenthal; Klaus Reincke, Wachenheim, all of Fed. Rep. of Germany

[73] Assignee: BASF Aktiengesellschaft, Ludwigshafen, Fed. Rep. of Germany

[21] Appl. No.: 729,221

[22] Filed: May 1, 1985

[30] Foreign Application Priority Data

May 10, 1984 [DE] Fed. Rep. of Germany ..... 3417239

[51] Int. Cl.[4] ..... C09B 67/00

[52] U.S. Cl. ..... 8/567; 8/127.6; 8/128 A; 8/133; 8/554; 8/606; 8/612; 8/685; 8/917

[58] Field of Search ..... 8/567, 606, 128 A, 127.6

[56] References Cited

U.S. PATENT DOCUMENTS

| | | | |
|---|---|---|---|
| 3,877,871 | 4/1975 | Abel | 8/128 A |
| 3,944,385 | 3/1976 | Hostettler et al. | 8/127.6 |
| 4,436,521 | 3/1984 | Annen et al. | 8/493 |
| 4,488,879 | 12/1984 | Fikentscher et al. | 8/539 |

FOREIGN PATENT DOCUMENTS

| | | |
|---|---|---|
| 1553811 | 1/1978 | United Kingdom . |
| 2038375 | 12/1979 | United Kingdom . |

OTHER PUBLICATIONS

"Wool Science Review 55", J. Lewis & T. Shaw, May 1978, International Wool Secretariat, Technical Centre, pp. 23–42.

*Primary Examiner*—A. Lionel Clingman
*Attorney, Agent, or Firm*—Oblon, Fisher, Spivak, McClelland & Maier

[57] ABSTRACT

Undyed or dyed wool with an antifelting finish is produced by a method in which the wool is chlorinated at a pH of less than 4 and then an aqueous solution of a quaternary product is applied onto the wool, this product being obtained by condensation of (a) piperazine and piperazine derivatives with (b) crosslinking agents, such as epichlorohydrin and ethylene chloride, in a molar ratio of from 1:0.9 to 1:1, and quaternization of the condensate with benzyl chloride, for 0.15 to 1.0 mole of benzyl chloride being employed per equivalent of nitrogen in component (a) in the quaternization.

To produce dyed wool with an antifelting finish, dyeing is carried out after the wool has been chlorinated.

10 Claims, No Drawings

PRODUCTION OF DYED OR UNDYED WOOL WITH AN ANTIFELTING FINISH: QUATERNIZED PIPERAZINE CONDENSATE

J. Lewis, in Wool Science Review 55 (1978) 23–42, published by the International Wool Secretariat (IWS), has described the processes which are of practical importance in the antifelting treatment of wool. The method which has become particularly well established in industry is the treatment of wool with chlorine, followed by the application of a prepolymer of a reactive polyamidoamine which is crosslinked with excess epichlorohydrin and is still water-soluble. This procedure is known as the Hercosett process. As reported by Lewis, this process is carried out today not just in a single washing unit comprising a plurality of baths, squeezers and a dryer backwashing bath, but by an even more complicated procedure involving seven baths followed by a dryer, a further bath and yet another dryer. This complicated apparatus is required in order that the problems associated with the resin application which arise when the wool provided with an antifelting finish is dyed can be overcome at least to some extent.

Dyeings on wool which has been provided with an antifelting finish by the Hercosett process and then dyed exhibit poor wetfastness. However, since articles of clothing made of wool which has been provided with an antifelting finish and dyed are frequently washed, these dyeings must be very wetfast. It has therefore been disclosed that the wetfastness of dyed wool provided with an antifelting finish by the Hercosett process can be improved by means of an after-treatment. Such processes are disclosed in, for example, German Laid-Open Applications Nos. DOS 2,801,535 and DOS 2,949,510.

It is an object of the present invention to provide products, for the antifelting treatment of wool, which are simpler to use in practice than the conventional resins and are furthermore more efficient than these resins. It is a further object of the present invention to produce dyed wool with an antifelting finish, the dyeing already having such a high wetfastness that the after-treatment otherwise usually carried out can be dispensed with.

We have found that this object is achieved, in accordance with the invention, by a process for the production of dyed or undyed wool with an antifelting finish, by chlorinating the wool at a pH of less than 4, if necessary carrying out dyeing and applying onto the wool an aqueous solution of a cationic condensate, if the cationic condensate used is a quaternary product which is obtained by condensation of (a) piperazine, bis-(1,4-aminopropyl)-piperazine, 1-aminoethylpiperazine, 1-methylpiperazine, 2-hydroxyethylpiperazine or bisbenzylpiperazine, or a mixture of these, with (b) ethylene chloride, an epihalohydrin, propylene chloride, 1,3-dichloro-2-hydroxypropane, bisepoxybutane or 1,4-dichlorobutane, or a mixture of these, in a molar ratio of from 1:0.5 to 1:1.1, preferably from 1:0.8 to 1:1.0, and quaternization of the condensate with benzyl chloride, from 0.15 to 1.0 mole of benzyl chloride being employed per equivalent of nitrogen in component (a) in the quaternization.

The wool treated by the novel process can be in the form of flocks, tops, yarn, woven goods or knitted goods. It is chlorinated in a first process stage, as in the Hercosett process, and, as in this process, it is essential that the pH of the chlorine treatment bath is less than 4, preferably from 0.5 to 3. Examples of suitable chlorinating agents are water-soluble hypochlorites, such as sodium hypochlorite, gaseous chlorine, which is passed into the water, or chlorine-donating agents, such as alkali metal dichloroisocyanurates. Examples of suitable apparatuses for the first treatment stage are backwashing baths for tops, leviathan baths for flocks, and padding mangles for piece goods. The chlorination can also be carried out batchwise in a dyeing apparatus, in a conventional manner. In this case, however, thorough circulation of the liquor or vigorous movement of the wool in the bath is required in order to ensure uniform chlorination of the wool at the proposed low pH. The temperature during the chlorination is usually less than 30° C. Chlorination is carried out by a prior art method so that the wool reacts with from 0.5 to 2% by weight of active chlorine.

After the chlorination of the wool, the excess chlorine is removed in a conventional manner with the aid of a reducing agent. For this purpose, the chlorinated wool is treated in a bath containing an aqueous solution of sodium sulfite, sodium bisulfite, sodium dithionite, thiourea dioxide or zinc hydroxymethanesulfinate at from 20° to 90° C. preferably from 30° to 80° C. After the chlorinated wool has been treated with the reducing agent, it is washed once or several times with water, preferably with warm water, squeezed out each time and dried. The wool treated in this manner is dried at as high as 150° C. preferably from 60° to 150° C.

If the intention is to produce dyed wool with an antifelting finish, the chlorinated wool is then dyed. Examples of suitable dyes are acid dyes, 1:1- and 1:2-metal complex dyes, after-chromed dyes and reactive dyes. These are the dyes usually employed for dyeing wool. Their structure can be found in the Color Index, and they are available commercially. Processes for dyeing wool also form part of the prior art, so that they require no further description here. Dyeing is mainly carried out in an aqueous medium at from 95° to 110° C., or by the cold pad-batch method.

When dyeing has, if desired, been carried out, the chlorinated wool is rinsed, and treated with an aqueous solution of a quaternary product which is obtained by condensation of (a) piperazine, bis-(1,4-aminopropyl)-piperazine, 1-aminoethylpiperazine, 2-hydroxyethylpiperazine, bis-b enzylpiperazine or 1-methylpiperazine with (b) ethylene chloride, an epihalohydrin (e.g. epichlorohydrin or epibromohydrin), propylene chloride, such as 1,2-propylene chloride or 1,3-propylene chloride, 1,3-dichloro-2-hydroxypropane, bis-epoxybutane or 1,4-dichlorobutane or a mixture of these in a molar ratio of from 1:0.5 to 1:1.1, preferably from 1:0.8 to 1:1.0, at a pH of from 6.5 to 12, preferably from 7 to 1 0, followed by quaternization of the condensate with benzyl chloride.

The pH is set during the condensation by using, if necessary, a base, such as sodium hydroxide solution, potassium hydroxide solution, sodium carbonate, calcium oxide, calcium hydroxide, barium oxide or barium hydroxide. If the compounds of group (a) are used in excess in the condensation, the basicity of these compounds results in an alkaline pH. The condensation is carried out in aqueous solution, the solids content of the latter being from 20 t o 60% by weight, and at from 60° to 100° C. The water-soluble non-quaternized condensates have a viscosity of not less than 500 mPa.s in 45% strength aqueous solution at 20° C. Particularly effective condensates are obtained if piperazine is condensed with epichlorohydrin or ethylene chloride, and the product is subsequently quaternized with benzyl chloride. Such products are known.

For quaternization of the condensates of components (a) and (b), from 0.15 to 1.0, preferably from 0.4 to 0.75, mole of benzyl chloride is employed per equivalent of nitrogen in component (a). The quaternization is preferably carried out in an aqueous medium at from 60° to 100° C. Both the condensation reaction and the quaternization of the condensates can be effected at above 100° C. and under superatmospheric pressure. This permits shorter reaction times. The aqueous solutions of the quaternized or partially quaternized condensates can be used directly for the treatment of the dyed or undyed chlorinated wool.

The treatment of the wool with the quaternary products can be carried out batchwise in a dyeing apparatus or continuously in a backwashing bath. The temperature of the polymer solution is not more than 100° C., preferably from 30° to 50° C., and the pH of the resin solution is brought to 4–10, preferably 7–8. From 0.5 to 3, preferably from 0.7 to 1.5, % by weight, based on the weight of the wool, of the quaternary condensates described in detail above are applied. The dyed or undyed chlorinated wool which has been provided with a resin coating of a quaternary product is, if required, rinsed and, if necessary, treated with softeners. Provided that the softener is compatible with the quaternary condensate, treatment of the wool with the softener can also be effected together with the polymer treatment. The wool treated in this manner is dewatered mechanically, for example by being squeezed, and is dried at from 80° to 150° C.

The quaternary products used according to the invention provide a good antifelting finish on the wool only when the chlorination stage is carried out at a pH of less than 4. In order for the wool to exhibit a particular resistance to felting, the amount of polymer required in the novel process is only about half that required in the Hercosett process for achieving the same effect. In a particularly advantageous, and therefore also preferred, embodiment of the novel process, the wool can be not only provided with an antifelting finish but also dyed in the course of this process. Dyeing is always carried out after chlorination of the wool and before application of the cationic polycondensate onto the wool. Consequently, it is possible to obtain wetfast, level dyeings, which do not require any further aftertreatment, even when acid dyes or metal complex dyes are used, these dyes otherwise causing problems with regard to the wetfastness of the dyeings on wool. These dyeings meet the requirements of the IWS for the superwash label (Test Method 185). Using the novel process, wool can be dyed even with metal complex dyes in the deepest hues, e.g. black or navy, so that the fastness properties of the resulting dyeings meet the stringent requirements of the IWS with regard to fastness to perspiration (TM 174) and to laundering (TM 193).

In the Examples which follow, parts are by weight, and percentages are based on the weight of the wool and, in the case of the polymeric products, on the anhydrous active substance. The viscosities of the condensates were measured using a rotational viscometer (Haake, RV 3).

PREPARATION OF THE QUATERNIZED CONDENSATES

Condensate 1

47.7 parts of condensation water were added to 95.5 parts of a 67.2% aqueous piperazine solution (0.75 mole), and the solution was heated to 75° C. As soon as this temperature was reached, 69 parts (0.75 mole) of epichlorohydrin were run in at from 70° to 80° C. in the course of 1 hour, and the mixture was then heated for 3 hours at 80° C. During this time, the viscosity of the reaction mixture increased to about 5000 mPa.s, while the pH decreased to 7.0. Thereafter, 134.3 parts of water and 59.7 parts of a 50% strength sodium hydroxide solution were added, and 94 parts of benzyl chloride were run in at 80° C. in the course of from 40 to 60 minutes. The benzylation was completed by heating the mixture for 2 hours at 80° C. The reaction mixture was cooled to 30° C., after which 343.1 parts of an 85% strength formic acid and 156.7 parts of water were added. A total of 1000 parts of condensate 1 were obtained.

Condensate 2

496.7 parts of epichlorohydrin were added to 516 parts (6 moles) of piperazine in 644 parts of water in the course of 50 minutes, the reaction temperature being allowed to increase from 50° to 88° C. during this procedure. Thereafter, the reaction mixture was kept at 90°–95° C. for a further 4 hours, after which the product had a viscosity of 4400 mPa.s (20° C.) and a chloride content of 3.25 millimoles/g. 414 parts of water were added, and the mixture was cooled to room temperature (viscosity 270 mPa.s at 20° C.).

3050 parts of propane-1,2-diol and 1050 parts of water were added to 1750 parts of this solution, 400 parts of 50% strength sodium hydroxide solution were introduced, and 882 parts of benzyl chloride were then added slowly at from 60° to 70° C. After a reaction time of 5 hours at 80° C., the clear solution had a chloride content of 1.59 millimoles/g, a pH of 3.9 and a viscosity of 90 mPa.s (20° C.). The content of active ingredient in the solution of condensate 2 was 21.9%.

Condensate 3

634 parts of water were added to 516 parts of 100% pure piperazine, and, when the temperature had reached 50° C., 444 parts of epichlorohydrin were slowly introduced continuously in the course of 1 hour. During the addition, the reaction temperature was increased to 90° C., and kept at this level for 4 hours. The condensate then had a chloride content of 3.1 millimoles/g and a viscosity of 750 mPa.s (20° C.). The content of active substance in the solution was brought to 40% with 369 parts of water.

7130 parts of 50% strength sodium hydroxide solution and 248 parts of propanediol were added to 332 parts of the condensate, and 252 parts of benzyl chloride were introduced at from 50° to 70° C. in the course of 40 minutes. After 5.5 hours at from 70° to 80° C., benzylation was complete. The mixture was diluted with 784 parts of water, the content of active ingredient beirg brought to 22%. The clear stable solution of condensate 3 had a pH of 4.4, a viscosity of 60 mPa.s (20° C.) and a chloride content of 1.6 millimoles/g.

EXAMPLE 1

In a continuous unit (backwashing bath) comprising 3 baths as well as squeezers and a dryer, 32 wool tops having a weight per unit length of 25 g/m and a wool fineness of 22 micrometers were treated according to the invention, at a rate of 16 m/min, by first passing the tops through an aqueous bath which contained sodium hypochlorite and sulfuric acid. The pH of the chlorination bath was 1.5, and the temperature during chlorination was 15° C. The wool absorbed 1.8% of active chlorine in the first bath. The tops were then fed continuously through a second bath which contained dissolved sodium sulfite and was at 40° C. The tops were then rinsed in a third bath containing water heated at 40° C., after which they were dried in a dryer at 95° C. until the residual moisture content was 10%. The wool was then made uniform on a gill box and formed into cones.

The wool pretreated in this manner was then dyed in a dyeing apparatus with an aqueous liquor which contained 3% of the blue acid dye denoted by Color Index No. 15707. The wool tops were then washed continuously in a washer at a speed of 16 m/min, in a bath containing water at 20° C., and passed continuously through a second bath which contained a 5% strength aqueous solution of condensate 1, had a pH of 7.5 and was at 40° C. The polymer coating was 1%. The wool tops were then washed in a third bath containing water at 40° C., and dried in a dryer at 95° C. until the residual moisture content was 10%.

The tops were then spun to yarn, from which knitted specimens were produced in accordance with Specification IWS-TM 192 and tested for antifelting properties and fastness. The results are shown in Table 1.

COMPARATIVE EXAMPLE 1

Wool tops as described in Example 1 were treated in a continuous unit comprising 8 baths as well as squeezers and a dryer, treatment being carried out at a speed of only 8 m/min. As described in Example 1, the wool was treated in the first bath at 15° C. with sodium hypochlorite, 1.8% of active chlorine and sulfuric acid being applied at pH 1.5; thereafter, the antichlor treatment with sodium sulfite was carried out in the second bath, followed by treatment in a wash bath at 40° C., these steps likewise being carried out as in Example 1. In contrast to Example 1, a fourth bath then followed, this bath containing an aqueous solution of a polyamidoamine resin crosslinked with epichlorohydrin. The resin coating was 1%, the temperature of the bath 40° C. and the pH 7.5. In the subsequent treatment bath, the same amount of this resin was again applied. The wool tops were rinsed with water at 35° C. in the downstream bath and then dried in the first dryer at 110° C. until there was no residual moisture. They were then passed through two baths, in which 0.2% of polyethylene softener was applied in each case. Thereafter, drying was carried out at 95° C. until the residual moisture content was 10%, and balls suitable for dyeing were formed on the gill box. Dyeing was effected in the same manner using the same blue acid dye (Color Index No. 15707) as in Example 1. This procedure was followed by continuous washing in a backwashing bath with water at 20° C. in the first bath and at 40° C. in two further baths, and drying at 95° C. to the usual residual moisture content. The tops were spun, the yarn was converted to knitted specimens according to IWS Specification TM 192, and the specimens were tested in respect of antifelting properties and fastness. The results and the requirements set by the IWS are also shown in Table 1.

TABLE 1

| | Felting shrinkage, based on area | Fastness to laundering IWS-TM 193 | | | Fastness to perspiration IWS-TM 174 | | |
|---|---|---|---|---|---|---|---|
| | IWS-TM 192 | H | HercoWo | C | H | HercoWo | C |
| Process according to Comparative Example 1 | 4% | 3 | 1 | 3 | 4 | 1–2 | 3 |
| Process according to Example 1 | 4% | 4–5 | 4 | 4–5 | 4–5 | 4–5 | 4–5 |
| IWS limit | 10% | 3–4 | 4 | 3–4 | 3–4 | 4 | 3–4 |

H = change in hue
HercoWo = bleeding of Hercosett wool
C = bleeding of cotton

As can be seen from the Table, the same excellent antifelting properties as those obtained in the prior art (Comparative Example 1) can be achieved by the novel process (Example 1) using half the amount of polymer and a substantially smaller number of treatment units. The goods dyed and provided with an antifelting finish by Comparative Example 1 do not possess the fastness properties required by IWS for granting the wool seal. To achieve this, an after-treatment would be necessary. On the other hand, the goods dyed according to Example 1 meet the requirements set by the IWS in respect of fastness of the dyeings to laundering and to perspiration.

EXAMPLE 2

Wool tops having a weight per unit length of 25 g/m and a wool fineness of 20 micrometers were chlorinated by the Kroy Deepin process (cf. Wool Science Review 55 (1978), 35) at 15° C. and a pH of 1.2. The wool absorbed 1.5% of active chlorine. Thereafter, the wool tops were dyed with an aqueous liquor containing 4.5% of the 1:2 chromium complex of the black acid dye C.I. 15711, dyeing being carried out for 60 minutes at 100° C. When dyeing was complete, cold water was added to the dyeing bath until the temperature of the latter decreased to 40° C., after which 1.2% of the condensate 2 was added, and the tops were treated in this liquor at pH 8 for 15 minutes. The goods were then rinsed, dried, processed to knitted specimens and tested. The results are shown in Table 2.

COMPARATIVE EXAMPLE 2

The procedure was initially carried out as described in Example 2, the wool tops were chlorinated and 2% of a polyamidoamine resin crosslinked with epichlorohydrin was then applied by the prior art method. The wool tops were then dyed, as in Example 2, with an aqueous liquor containing 4.5% of the 1:2 chromium complex of the black acid dye C.I. 15711, after which they were rinsed, passed through a backwashing bath, dried, converted to knitted specimens and tested. The results are shown in Table 2.

TABLE 2

| | Felting shrinkage, based on area | Fastness to laundering IWS-TM 193 | | | Fastness to perspiration IWS-TM 174 | | |
|---|---|---|---|---|---|---|---|
| | IWS-TM 192 | H | HercoWo | C | H | HercoWo | C |
| Comparative Example 2 | 2% | 3–4 | 1 | 4 | 4 | 2 | 4 |
| Example 2 | 2% | 4–5 | 4–5 | 4–5 | 4–5 | 4 | 4–5 |

Only the treatment according to the invention gives both good antifelting properties and good fastness.

EXAMPLE 3

Knitted articles produced from a black-and-white mottled Shetland wool yarn whose black component had already been dyed, in flock form, with the 1:2 chromium complex of the black acid dye C.I. 15711 was washed in a paddle dyeing machine, rinsed, and treated with an aqueous solution of sodium dichloroisocyanurate at 14° C. and pH 3.2. Absorption of chlorine was 1%. In order to obtain good levelness during the chlorine treatment, the chlorine donor was added a little at a time. When the chlorination was complete, chlorine was removed with sodium sulfite, after which rinsing was carried out. The goods were then divided up.

(a) 1 part of the chlorinated goods was treated with a 0.035% strength aqueous solution of condensate 3 for 15 minutes at pH 7 and at 40° C., using a liquor ratio of 1:30, so that the wool absorbed 1% of the said condensate. The goods were dewatered mechanically, and dried in a dryer at 90° C.

(b) The other part of the chlorinated wool was treated, at pH 8, with a polyamidoamine resin crosslinked with epichlorohydrin, so that the resin coating was 2%.

The pullover parts obtained as described under (a) and (b) were then tested with regard to antifelting properties. Both parts met the IWS Standard TM 185. In case (b) on the other hand, those wool fibers in the blend which had been dyed black bled onto the white fibers, during testing of the fastness to laundering and to perspiration, to such an extent that the tinctorial appearance was greatly modified. In the case of (a), the mottled goods retained their appearance because there was no bleeding of the black dye.

We claim:

1. A process for the production of undyed wool with an antifelting finish, by chlorinating the wool at a pH of less than 4, and applying onto the wool an aqueous solution of a cationic quaternary condensate which is obtained by condensation of (a) piperazine, bis-(1,4-aminopropyl)-piperazine, 1-aminoethylpiperazine, 2-hydroxyethylpiperazine, bis-benzylpiperazine or 1-methylpiperazine, or a mixture of these, with (b) ethylene chloride, an epihalohydrin, propylene chloride, 1,3-dichloro-2-hydroxypropane, bis-epoxybutane or 1,4-dichlorobutane, or a mixture of these, in a molar ratio of from 1:0.5 to 1:1.1, and quaternization of the condensate with benzyl chloride, from 0.15 to 1.0 mole of benzyl chloride being employed per equivalent of nitrogen in component (a) in the quaternization.

2. The process as claimed in claim 1, wherein from 0.5 to 3% by weight, based on dry wool, of the quaternary product is applied.

3. The process as claimed in claim 1, wherein the pH of the aqueous solution of the quaternary product is from 4 to 10.

4. The process as claimed in claim 1, wherein the pH of the aqueous solution of the quaternary product is from 7 to 8.

5. A process for the production of dyed wool with an antifelting finish, by chlorinating the wool at a pH of less than 4, dyeing the chlorinated wool and applying onto the wool an aqueous solution of a cationic quaternary condensate which is obtained by condensation of (a) piperazine, bis-(1,4-aminopropyl)-piperazine, 1-aminoethylpiperazine, 2-hydroxyethylpiperazine, bis-benzylpiperazine or 1-methylpiperazine or a mixture of these, with (b) ethylene chloride, an epihalohydrin, propylene chloride, 1,3-dichloro-2-hydroxypropane, bis-epoxybutane or 1,4-dichlorobutane, or a mixture of these, in a molar ratio of from 1:0.5 to 1:1.1, and quaternization of the condensate with benzyl chloride, from 0.15 to 1.0 mole of benzyl chloride being employed per equivalent of nitrogen in component (a) in the quaternization.

6. The process as claimed in claim 5, wherein from 0.5 to 3% by weight, based on dry wool, of the quaternary product is applied.

7. The process as claimed in claim 5, wherein a wool which has been chlorinated at a pH of from 0.5 to 3 and dyed with a metal complex dye is treated with from 0.7 to 1.5% by weight of the quaternary product.

8. The process as claimed in claim 5, wherein the pH of the aqueous solution of the quaternary product is from 4 to 10.

9. The process as claimed in claim 5, wherein the pH of the aqueous solution of the quaternary product is from 7 to 8.

10. The process as claimed in claim 5, wherein a wool which has been chlorinated at a pH of from 0.5 to 3 and dyed with a metal complex dye is treated with from 0.7 to 1.5% by weight of the quaternary product.

* * * * *